US007980625B2

(12) United States Patent
Worthington

(10) Patent No.: US 7,980,625 B2
(45) Date of Patent: Jul. 19, 2011

(54) BACK JACK

(76) Inventor: Christian Shane Worthington, Big Bear Lake, CA (US)

( * ) Notice: Subject to any disclaimer, the term of this patent is extended or adjusted under 35 U.S.C. 154(b) by 496 days.

(21) Appl. No.: 12/157,733

(22) Filed: Jun. 13, 2008

(65) Prior Publication Data

US 2009/0309001 A1 Dec. 17, 2009

(51) Int. Cl.
*A47C 7/54* (2006.01)
*A47C 1/00* (2006.01)

(52) U.S. Cl. .... 297/4; 248/125.8; 248/397; 297/411.23; 297/411.33

(58) Field of Classification Search ..... 602/19, 602/36; 297/195.11, 411.1, 411.23, 411.33, 297/4, 423.12, 414; 248/125.1, 118, 397, 248/125.8
See application file for complete search history.

(56) References Cited

U.S. PATENT DOCUMENTS 699,932 A * 5/1902 Smith ..... 297/4
1,417,250 A * 5/1922 Kelly ..... 135/65
3,754,787 A * 8/1973 Garber ..... 297/195.11
3,857,388 A * 12/1974 Frankel ..... 602/19
4,565,409 A * 1/1986 Hollonbeck et al. ..... 297/411.1
4,589,406 A * 5/1986 Florek ..... 602/19
4,829,989 A 5/1989 Deamer et al.
5,176,622 A 1/1993 Anderson et al.
5,224,924 A * 7/1993 Urso ..... 602/19
5,323,942 A 6/1994 Dahan
5,462,518 A * 10/1995 Hatley et al. ..... 602/36
6,068,606 A 5/2000 Castel et al.
7,325,868 B2 * 2/2008 West et al. ..... 297/4

* cited by examiner

*Primary Examiner* — Tan Le
(74) *Attorney, Agent, or Firm* — Kenneth R. Rice

(57) ABSTRACT

The Back Jack is an upper body support to be used when a person is working on their hands and knees. The Back Jack has a base with a chest pad on one side and a support rod pivotally mounted on the other side. The chest pad is made of a high quality or memory foam and covered with a vinyl material. The support rod pivot joint can be locked in a working position perpendicular to the base, a transport position parallel to the base, and one or more intermediate positions. The support rod is made of telescoping sections to accommodate workers of different heights. The telescoping sections are adjusted by a spring pin fixed to an inner shaft which fits through holes in an outer shaft. A pivoting rubber foot is mounted to the bottom of the inner shaft.

1 Claim, 2 Drawing Sheets

BACK JACK

BACKGROUND OF THE INVENTION

This invention relates, in general, to a device for an upper body support, and, in particular, to an upper body support for a person working on their hands and knees.

People who work on their hands and knees often suffer great lower back, knee and wrist pain from long hours of working in that position. The upper body support will provide support of the upper body weight to alleviate stress and strain on the lower back, spine and muscles, as well as evenly distributing body weight to three points, both knees and the chest. This will relieve strain and pain to the back, hands, wrists and knees, and will free up both hands for working on their hands and knees.

Applications of the upper body support include all flooring work, painting, plumbing, carpentry, electrical, tile and masonry, mechanics, gardening, home and commercial cleaning auto detailing, etc. or any work related task involving a need to be in an "all fours" position. Benefits include longer duration of working, decreased stress and strain on the back, decreased joint and wrist pain, arms and wrist, improved mobility, the ability to use both hands for working, less wear and tear on the body, and increased longevity of working years due to decrease in strain on the lower back, knees and wrists.

DESCRIPTION OF THE PRIOR ART

Various types of back support devices have been proposed in the prior art.

U.S. Pat. No. 6,068,606 to Castel et al. discloses a back support brace that has suspenders that fit onto a user's shoulders and a brace that wraps around the user's waist. This reinforces the user's back to reduce the risk of lower back injury U.S. Pat. No. 5,323,942 to Dahan discloses a support for a photographer that has suspenders that fit onto a user's shoulders and a brace that wraps around the user's waist. This provides additional support for equipment held by the photographer.

U.S. Pat. No. 5,176,622 to Anderson et al. discloses a frame that has an attached spring that is compressed when a user bends over and the spring helps the user straighten up. This device reduces the stress on the back muscles and assists the user in returning to an upright position.

U.S. Pat. No. 4,829,989 to Dreamer et al. discloses a frame that has an attached spring that is compressed when a user bends over and the spring helps the user straighten up. This device also reduces the stress on the back muscles and assists the user in returning to an upright position.

None of the prior art devices support the upper body when the user is working on their hands and knees.

SUMMARY OF THE INVENTION

The present invention is directed to a device for an upper body support, and, in particular, to an upper body support for a person working on their hands and knees.

It is an object of the present invention to provide a new and improved device to ease the stress on a worker's back when they are positioned on their hands and knees.

It is an object of the present invention to provide a new and improved device to support a worker's upper body to enable them to use both hands freely to accomplish a task while in a hands and knees position.

It is an object of the present invention to provide a new and improved device which has adjustable leg for supporting the upper body of a person working on their hands and knees.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
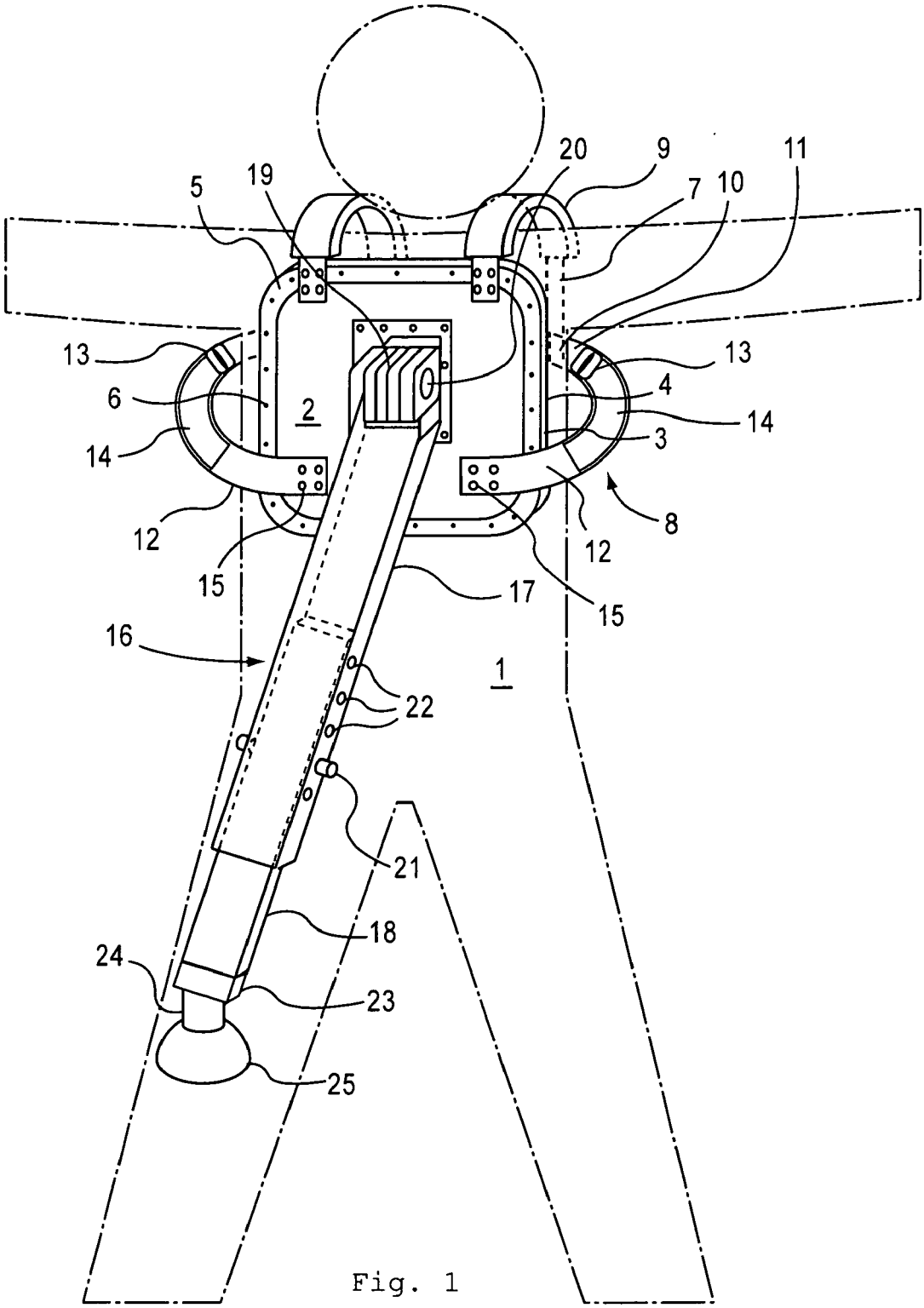
FIG. 1 is a detailed view of the upper body support.

Referring now to the drawings in greater detail, FIG. 1 shows the Back Jack mounted on a worker's body 1. The base 2 is about 8 inches high and 10 inches wide. It is made of a strong composite material or light weight material such as aluminum. A chest pad 3 is mounted to the base on the side towards the body 1. The chest pad 3 is made of a memory foam, or other high quality foam. It is about 3 inches thick. The chest pad 3 has a vinyl covering 4, which is preferably black but may be other colors. Other well known materials may also be used as a covering 4 for the chest pad 3. The pad covering 4 is held to the base 2 by a mounting plate 5 connected to the base 2. This is preferably on the side of the base 2 away from the body 1, but could be on the edge of the base 2 or on the side towards the body 1. The mounting plate 5 is connected to the base 1 by upholstery tacks 6 or similar fastenings.

The Back Jack 2 is mounted to the body 1 by shoulder straps 7 and back strap 8. The straps 7, 8 are made of a lightweight and durable material, such as nylon. The shoulder straps 7 have padding 9 where they pass over the shoulders of the body 1. The shoulder straps are connected to the back strap by stitched joint 10. The back strap 8 has a front section 11 and a rear section 12. A buckle 13 is mounted on the back section 11 to receive the front section 12. The front section 12 has fastenings 14 to hold it in adjustment after it has been passed through the buckle 13. The fastenings may by Velcro™ or similar hook and loop fasteners. The front section 12 of the back strap 8 is connected to the base 2 by fasteners 15 such as screws or rivets.

Figure 2:
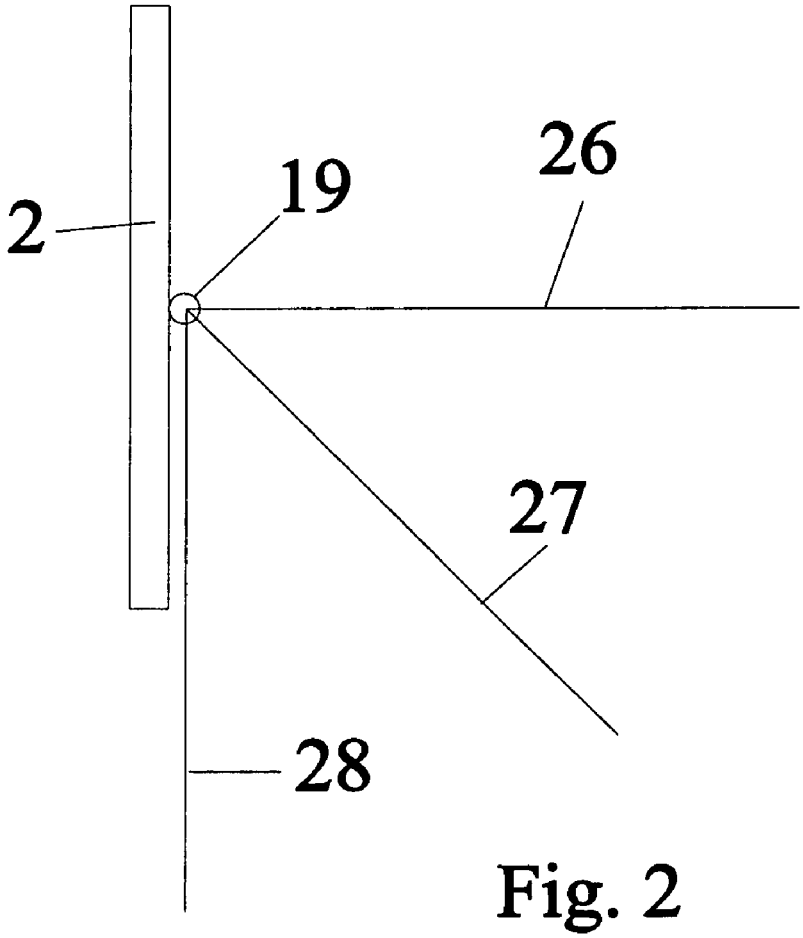
FIG. 2 shows three positions for the support rod.
Figure 3:
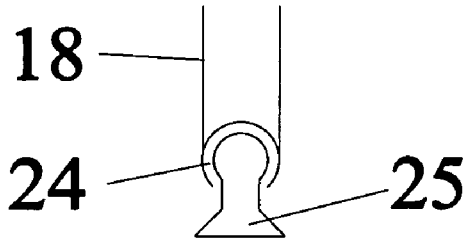
FIG. 3 is a cross-sectional view of the ball and socket connection between the non-skid foot and the support rod.

The support rod 16 is telescoping and is made of an outer shaft 17 and an inner shaft 18. The support rod 16 is made of a material that will support at least 200 pounds. The outer shaft 17 and inner shaft 18 are each about 16 inches long. The outer shaft 17 is connected to the base 2 by a pivot joint 19. The pivot joint 19 is spring loaded (not shown) and is adjustable by a locking push button 20. The pivot joint 19 can lock in three or more positions. FIG. 2 shows these positions. The first position 26 is the in use position perpendicular to the base 2 and the body 1. The second position 27 is an intermediate position at a 45 degree angle downward to the base 2 and body 1. The third position 28 is a transport position that is downward and parallel to the base 2 and body 1. The pivot joint may be designed to lock in multiple intermediate positions. The inner shaft 18 is received inside the outer shaft 17 and is held in place by spring pins 21. The spring pins 21 are fixed to the inner shaft 18. The spring pins fit in multiple holes 22 in the outer shaft 17 to allow the support rod 16 to be adjustable in length. The range of adjustment of the support rod 16 is preferably 16 inches to 26 inches to accommodate workers of varying height. The distal end 23 of the inner shaft 18 is connected to a ball and socket joint 24 which holds the foot 25. FIG. 3 shows a cross-sectional view of the ball and socket joint 24 between the inner shaft 18 and the non-skid foot 25. The foot 25 is made of a non-skid rubber material and is similar to the feet used on crutches and canes.

Although the Back Jack upper body support and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An upper person support for a person working on their hands and knees on a floor, the support comprising:

a base plate, said person having a chest, sides, a back and feet, said base plate to be placed against said chest, adjustable straps attached to said base plate, said adjustable straps extendable around said sides and over said shoulders of said person, said adjustable straps having connectors for securing said base plate to said person, said adjustable straps having padding to protect said person, adjustable support means connected to said base plate by a pivoted and resilient connection, said adjustable support means extending from said base plate to said floor when said person is working on their hands and knees, said adjustable support means is comprised of an inner part and an outer part, said inner part comprises spring pins which engage multiple holes in said outer part to provide multiple length adjustments, said pivoted and resilient connection being resiliently biasing said adjustable support means towards said feet, said pivoted and resilient connection being lockable in multiple positions, said adjustable support means being adjustable to multiple lengths to enable said persons of different sizes to use said support, a cushion pad attached to said base plate between said base plate and said person, said cushion pad comprises one of a high quality foam and a memory foam, a vinyl covering enclosing one of said high quality foam and said memory foam, a mounting plate connected to said base plate to hold said cushion pad and said vinyl covering to said base plate, a non-skid foot pivotally mounted to the end of said adjustable support distal from said base plate.

* * * * *